United States Patent [19]

Melby

[11] Patent Number: 4,705,028

[45] Date of Patent: Nov. 10, 1987

[54] BODY STIMULATING MECHANICAL JOGGER

[76] Inventor: Phillip J. Melby, P.O. Box 656, Mason City, Iowa 50401

[21] Appl. No.: 911,884

[22] Filed: Sep. 26, 1986

[51] Int. Cl.[4] ..... A61H 1/02

[52] U.S. Cl. ..... 128/25 B; 272/96; 272/70

[58] Field of Search ..... 272/96, 70; 128/25 B

[56] References Cited

U.S. PATENT DOCUMENTS

| | | | |
|---|---|---|---|
| 2,253,996 | 8/1941 | Bechman | 272/57 |
| 2,427,761 | 9/1947 | Bull | 272/70 |
| 3,511,500 | 5/1970 | Dunn | 272/79 |
| 3,525,522 | 8/1970 | Piller | 272/79 |
| 3,598,404 | 8/1971 | Bowman | 272/57 D |
| 3,628,791 | 8/1970 | Garcia | 272/83 R |
| 3,911,907 | 10/1975 | Smith | 128/24 R |
| 3,917,261 | 11/1975 | Small | 272/96 |
| 4,200,282 | 4/1980 | Agyagos | 128/25 B X |
| 4,270,749 | 6/1981 | Hebern | 272/96 |
| 4,319,749 | 3/1982 | Agyagos | 272/146 |

*Primary Examiner*—Andrew V. Kundrat

*Attorney, Agent, or Firm*—Robert T. Johnson

[57] ABSTRACT

A body stimulating mechanical jogger, for use by a person in a standing, sitting, or back laying position comprising a removable handle bar frame 1, mounted on a housing body 8 and body housing body containing means to move foot treadles 6, in a reciprocating motion, by action of cam wheels 10 driven by electric motor 4.

7 Claims, 8 Drawing Figures

BODY STIMULATING MECHANICAL JOGGER

In recent years, it has been found that exercise is very important and stimulates the head to aid in good health.

There are various devices people use for exercise. Some of these are: walking on a traveling endless belt, running in place, weight lifting, leg weight lifting, rowing, etc.

Most of these exercise methods require either standing upright, or sitting down.

An object of this invention is to disclose a body stimulating mechanical jogger that can be mounted in a horizontal positon that can be utilized by a person in a prone position, such as on a bed, floor or table.

Another object of this invention is to disclose a mechanical jogger which can be activated in an upright position to actuate the legs of a person standing thereon, as well as being operable in a horizontal position.

Another object of this invention is to disclose a body stimulating mechanical jogger machine comprising a housing, an electric motor mounted therein, and an off-center wheel, otherwise called a cam wheel, which is mounted in an off-center position of said off-center wheel a jointed drive shaft connected to a foot tredal.

Another object of this invention is to disclose a body stimulating mechanical jogger, comprising a housing containing therein an electric drive motor, a driven shaft connecting said motor to cam wheels and cam followers contacting said cam wheel with said cam followers attached to foot treadles.

Another object of this invention is to disclose a body stimulating mechanical jogger comprising a housing, and mounted therein an electric motor drive, cam wheels, driven by the electric motor drive through a drive belt connected to a driven wheel rigidly mounted on a shaft, on which shaft the cams are rigidly mounted and the cam wheels are in contact with foot treadles to actuate foot treadles in a reciprocating motion.

Another object of this invention is to disclose a body stimulating mechanical jogger comprising a housing and handle bar frame mounted on said housing and wherein said handle bar frame has segments aligned with the side plane of said housing.

Another object of this invention is to disclose a body stimulating mechanical jogger having means to actuate the electric motor drive, said means comprising an on-off motor speed control mounted on handle bar frame.

Another object of this invention is to disclose a body stimulating mechanical jogger wherein foot anchorage is provided on each foot treadle.

Another object of this invention is to disclose a body stimulating mechanical jogger mounted in a horizontal position, whereby the feet of a user can be anchored onto individual foot treadles to both push and pull the feed of said user on reciprocation of said foot treadles.

Another object of this invention is to disclose a body stimulating mechanical jogger of claim 5, mounted in a horizontal position, and wherein the feet, of a user in a horizontal back laying position, can be attached to the individual foot treadles.

Another object of this invention is to disclose a body stimulating mechanical jogger which can be disassembled or "knocked down" by removal of handle bar frame from the housing body of said jogger.

BACKGROUND ART PERTAINING TO THIS INVENTION

U.S. Pat. No. 2,253,996 to Bechman for Exercising Device. This patent covers a balance board and actuated by impulse of the feet of the user.

U.S. Pat. No. 3,441,271 to Palacios for Planetary Exercise. This patent covers an exerciser adapted to provide planetary movement to a person standing thereon.

U.S. Pat. No. 3,511,500 to Dunn for Constant Resistance Exercise Device. This covers a beam mounted on an oscillatable shaft, and having adjustable braking means for frictional resistance to the oscillation of said shaft.

U.S. Pat. No. 3,525,522 to Piller for Friction Type Foot Exercising Device. This covers a pair of foot pedals pivotally supported intermediate the ends thereof in a side by side relationship mounted on a shaft.

U.S. Pat. No. 3,598,404 to Bowman for Exercising Apparatus Including Pivotally Connected Weight-Supporting Units. This covers leg calf exercising apparatus comprised of feet retaining platforms for toe-up exercises, and the foot engaging surfaces are disposed at different lateral angles.

U.S. Pat. No. 3,628,791 to Garcia for Pivoted Jogging Platform With Adjustable Spring-Resistance. This covers a jogging device having a pair of pivoted foot pedals or platforms that are yieldingly supported by a spring mechanism.

U.S. Pat. No. 4,270,749 to Hebern for Exercising Device. This covers an exercising device for use by a person in a standing position, and having a planar treadle mounted for a rocking movement about a horizontal axis.

U.S. Pat. No. 4,319,749 to Agyagos for Multiple Exercising Device. This covers an exercising device consisting essentially of a rectangular box having spaced pre set holes into which freely rotatable disks may be inserted to be actuated by the exerciser standing thereon.

U.S. Pat. No. 3,911,907 to Smith for Planetary Exercising Machine. This covers a machine in which the user's legs are simultaneously subjected to cyclic twisting in two directions, while simultaneously the entire lower torso is twisted cyclically. All of this exercising motion is produced by a variable speed drive motor.

None of the above, either singly or collectively, is pertinent art which discloses this present invention of Melby, in view of the fact that only the reference U.S. Pat. No. 3,911,907 to Smith discloses a motor drive, and further this Smith patent discloses a cyclic twisting motion to a person standing thereon, and is not usable by a person in a prone back laying position as disclosed in this present Melby invention.

The above mentioned Smith patent does not disclose reciprocating motion actuating the user's legs, neither is this Smith machine usable in a horizontal position.

EXPLANATION OF INVENTION

This invention concerns a human body exerciser device comprising forcing a reciprocating movement of legs, in a standing, sitting or laying down position of the body.

Up to the present time, exerciser machines required standing or sitting thereon and could not be changed to be used in more than one position. For example, a jogger exerciser requires one to be essentially in a vertical position and walk or run in position on an endless belt.

This present invention discloses a body stimulating mechanical jogger that can be utilized by a person in a vertical position or in a horizontal position or in any position in between horizontal and vertical, and comprises two foot treadles actuated by cams, in alternate reciprocal movement.

As noted above, this present invention can be utilized by a person in a horizontal position, which means this exerciser can be used by a person on a bed while laying on their back.

DETAILED DESCRIPTION OF INVENTION

This invention comprising a body stimulating mechanical exerciser machine to move the feet of a person, in a reciprocating manner to exercise the leg muscles. This machine will function when standing on a floor, so that the foot treadles can be stepped on to by a person in a vertical position or the machine can be mounted either on or at the foot of a bed, and a person's feet placed on the foot treadles and the machine actuated while the person is in a horizontal position.

Figure 1:
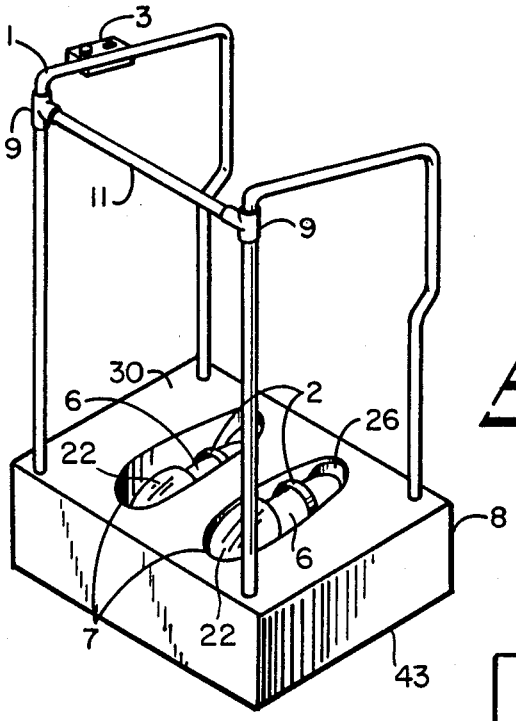
FIG. 1—This is an isometric view wherein:
1—Handle bar frame
2—Over arch straps
3—Switch control
6—Foot treadles
7—Foot treadle wells
8—Housing body
9—Cross bar connection to handle bar frame
11—Cross bar
22—Foot toe caps
26—Heel cup
30—Top surface FIG. 2—This is a plan view wherein:
1—Handle bar frame
2—Over arch straps
3—Switch control
4—Electric Motor
5—Wheel housing
6—Foot treadles
7—Foot treadle wells
8—Housing body
9—Cross bar connection to handle bar frame
11—Cross bar
22—Foot toe caps
26—Heel cup
30—Top surface FIG. 3
1—Handle bar frame
4—Electric motor drive
5—Wheel housing
6—Foot treadle
7—Foot treadle well
8—Housing body
9—Cross bar connection to handle bar frame
10—Cam wheels
11—Cross bar connector
13—Shaft
14—Castor wheels
24—Drive belt
25—Driven wheel
30—Top surface FIG. 4—This is an enlarged elevation phantom view of the foot treadle drive wherein:
2—Over arch sraps
5—Caster wheel housings
6—Foot treadle
7—Foot treadle well
8—Housing body
10—Cam wheels
13—Shaft
14—Caster wheels
15—Guide pin shaft anchor to foot treadle
16—Handler bar mount socket
17—Stops
18—Compression springs
19—Guide pin shaft
22—Foot toe cap
26—Heel cup
30—Top surface
31—Guide pin shaft cylinders
33—Washer collar
34—Threaded section for nut and washer FIG. 5—This is an internal view of the base showing the cams and motor drive wherein:
4—Electric motor
10—Cam sheels
13—Axle for cams
24—Drive belt
25—Driven wheel FIG. 6—This is an elevation view of the exerciser wherein:
1—Handle bar frame
8—Housing body
21—Bed
28—Stand for horizontal mounting
29—Bumper rim
30—Top surface
32—Patient FIG. 7—This is an enlargement of guide pin shaft which can best be described as a "J" shaft wherein:
19—Guide pin J shaft
33—Washer collar
34—Threaded section for nut and washer
35—Short leg It is herein pointed out that the short leg 35 of J shapt 19, is mounted in 15 guide pin shaft anchor to foot treadle 6. There are two J shafts under each foot treadle.

FIG. 1 is an elevation and shows the machine base unit 8 as it would be mounted sitting upright on a floor wherein 1 is a railing to maintain the stability of a person standing on foot treadles, 6, and wherein foot straps 2, and foot bumpers 22, function to hold the feet of the user on the foot treadles 6.

Figure 2:
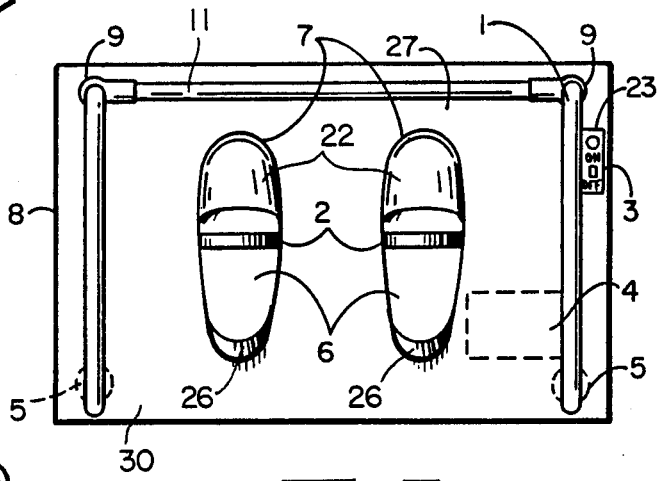

FIG. 2 is a plan view of the machine base unit or housing body 8 showing handle bar frame 1, foot straps 2, control box 3, phantom of electric motor drive 4, recessed wheel housings 5, one of which is on each corner, two foot treadles 6, two foot treadle wells 7, and cross bar connection to handle bars 9 and foot toe caps 22.

Figure 3:
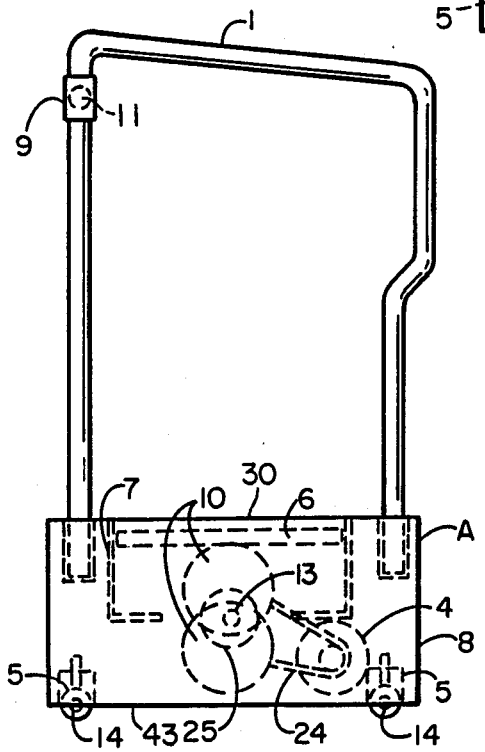

FIG. 3 is a side elevation phantom view of the machine base unit or housing body 8 wherein is shown handle bar frame 1, electric motor drive 4, wheel housing 5, foot treadle 6, cam wheels 10, foot treadle well 7, cross bar connection to handle bar frame 9, caster wheels 14, drive belt 24.

Figure 4:
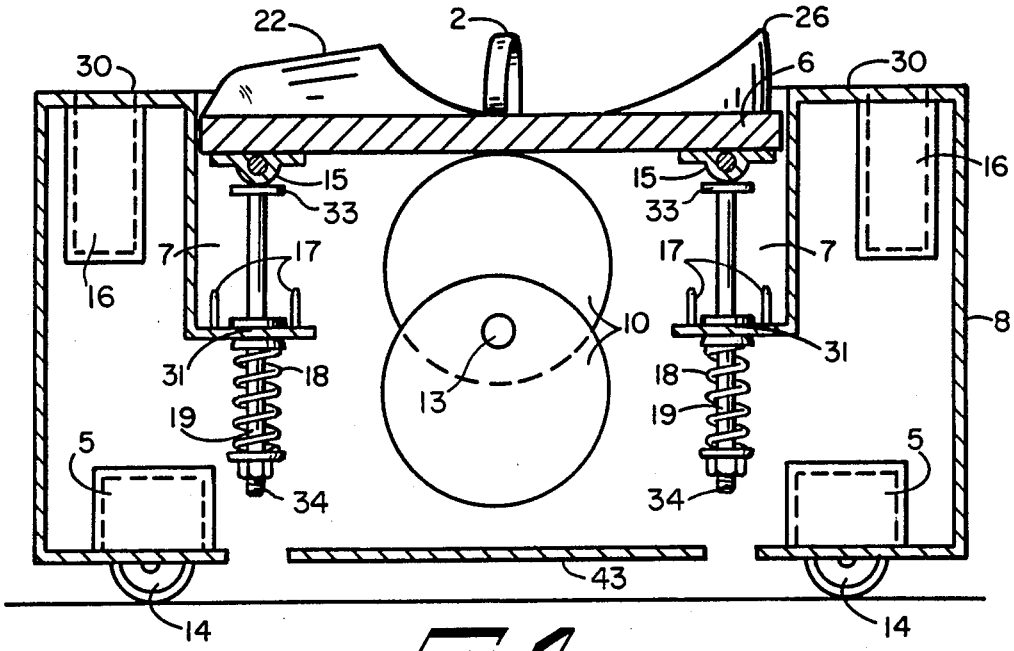

FIG. 4 is an enlarged elevation phantom view of machine base unit or housing body 8, comprising foot treadle 6, cam wheels 10, on shaft 13, caster wheels 14, foot pad bumper stops 17, compression springs 18, guide pin shaft 19. On each foot treadle 6 is mounted toe cap 22, heel cup 26 and over arch straps 2.

Figure 5:
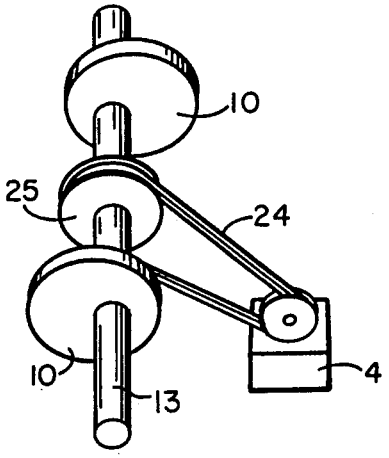
Figure 7:
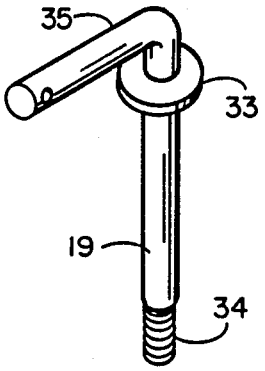

FIG. 5 is a perspective detail of cam wheels 10 mounted on drive shaft or axle for cams 13, driven wheel or pulley 25, drive belt 24, and electric motor drive 4.

Figure 6:
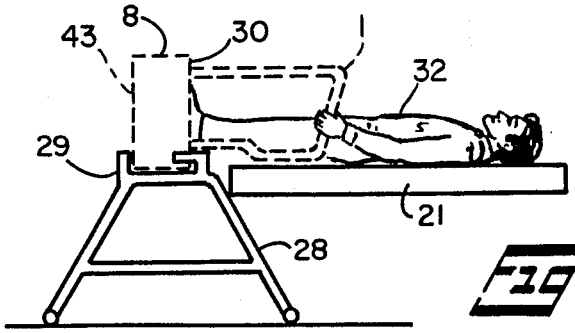
Figure 8:
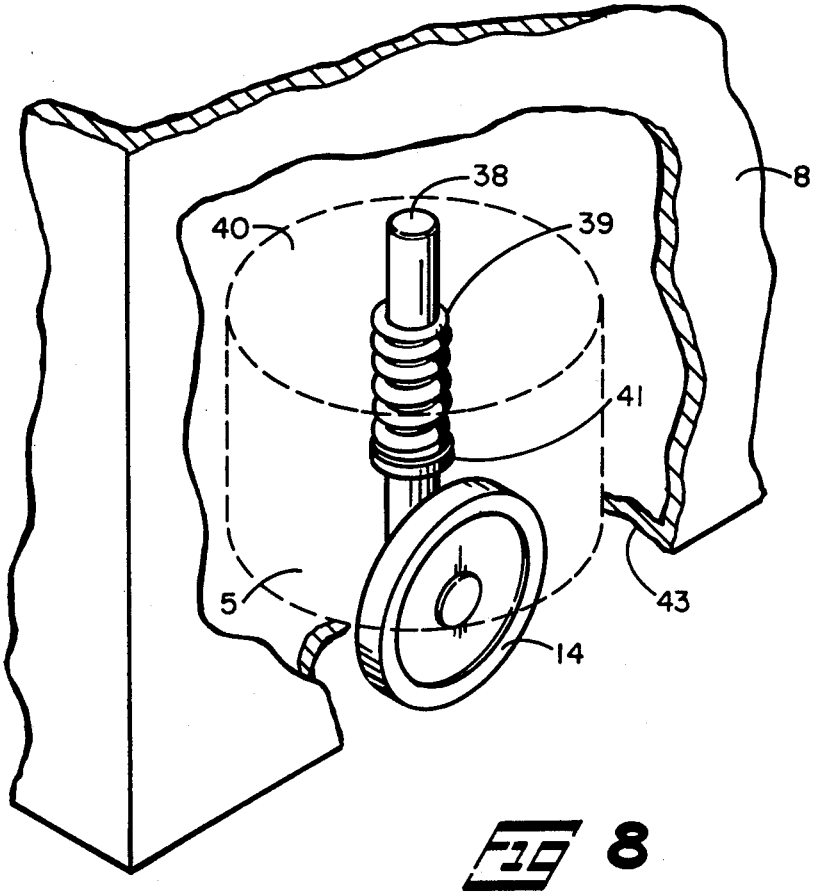
FIG. 8—This is an enlarged view of caster wheel mount 14, wherein:
5—Caster wheel housing
14—Caster wheels
38—Caster wheel mount pin
39—Compression spring
40—Compression spring bumper on housing 8
41—Compression spring bumper on caster wheel mount pin

FIG. 6 is an elevation view of the exerciser showing handle bar frame 1, housing body 8, and the housing body 8 mounted horizontally at the foot of a bed 21, on stand 28 for horizontal mounting, bumper rim 29 and patient 32 using said exerciser, top surface 30 in vertical position.

DETAILED DESCRIPTION

This invention of a body stimulating mechanical jogger for the human body, comprises a base or housing 8, in which is mounted electric motor 4, to drive the cam wheels 10, through drive belt 24, the cam wheels are rigidly mounted on shaft 13, which shaft 13 in turn is mounted on suitable supports or bearings to allow freedom of rotation of the shaft, when driven by belt 24, connecting driven wheel or pulley 25 to electric motor 4. Foot treadles 6, are so mounted to be in continuous contact with cam wheels 10, each foot treadle 6 to contact one of the cams as shown in FIG. 4.

Handle bar frame 1, is mounted on base 8, perpendicular to top surface 30 of base 8.

This invention discloses a body stimulating mechanical exerciser which when used vertically, a person steps on foot treadles 6, one foot on each foot treadle, the handle bar frame 1, serves to stablize the person standing on said foot treadles 6. Motor drive 4 is turned off-on with variable speed controlled at switch control 3. Drive belt 24 connects motor drive 4 to driven wheel 25.

Said driven wheel 25 is rigidly mounted on shaft 13, on which shaft is mounted cam wheels 10. There is one cam wheel 10 under each foot treadle 6. Compression spring 18, mounted on guide pin shaft 19, maintains the two foot treadles in contact with cam wheels 10. Bumpers 17 are located under toe and heel ends of each foot treadle 6. To insure even reciprocation of each foot treadle 6, guide pin shafts 19 reciprocate through cylinders 31, two of which are mounted under each foot treadle 6, and serves to prevent skewing of the foot treadles 6, and to insure that said foot treadles do not tilt, to cause interruption of reciprocating action.

To allow for mobility of this mechanical exerciser, the unit or base 8 is mounted on caster wheels 14, one caster wheel is mounted on each corner of the base 8, so that when said base 8 is setting upright on a floor, the caster wheels 14 carry the load.

This body stimulating mechanical exerciser, when used vertically by a person standing thereon, it is necessary that the unit remain stationary on a floor, and to insure that this be done the caster wheels pins are mounted on compression springs such that the housing body 8 is raised off of the floor, however when a person steps on the foot treadles 6 the springs 39, mounted around the pins 38, of the caster wheels 14, are compressed to such an extent that the bottom 43, of housing body 8 is resting on the floor.

To insure that the housing body 8 will not slip on a bare floor, the bottom 43, of the housing body 8, can be coated with, for example, a rubber sheet.

This body stimulating mechanical jogger invention is of such a compact structure that this structure or machine can be used in a horizontal position so that it can be mounted on a bed or at the foot thereof as shown in FIG. 6 in a horizontal position, to be used as an exerciser by a person laying in bed, on their back, and as such is of much value to bedridden people to serve as a body stimulating mechanical exerciser.

This present invention covering a body stimulating mechanical jogger is of such construction that the unit can be disassembled or knocked down, by removing the handle bar frame 1, mounted on housing body 8. The handle bar frame 1 can be removed from base 8, holding the handle bar frame 1 in sockets, 16.

Having described my invention, I claim:

1. A body stimulating mechanical jogger wherein the improvement comprises:

(a)—a housing and (b)—mounted therein an electric motor drive, cam wheels, driven by said electric motor drive through a (c)—drive belt connected to a driven wheel, mounted on a shaft, on which shaft said cam wheels are rigidly mounted and (d)—said cam wheels in contact with foot treadles to actuate said foot treadles in a reciprocating motion, and (e)—switch control means to actuate said electric motor drive, (f)—and handle bar frame mounted on said housing and (g)—said switch control means mounted on said handle bar frame of said mechanical jogger.

2. A body stimulating mechanical jogger of claim 1, wherein the improvement comprises compression spring mounted castor wheels in castor wheel housings, said castor wheel housings located on underside of housing body.

3. A body stimulating mechanical jogger having means to actuate the electric motor drive of claim 1, said means comprising an on-off speed control mounted on handle bar frame.

4. A body stimulating mechanical jogger of claim 3, wherein foot anchorage is provided on each foot treadle.

5. A body stimulating mechanical jogger of claim 4, mounted in a horizontal position, whereby the feet of a user can be anchored on to individual foot treadles to both push and pull the feet of said user on reciprocation of said foot treadles.

6. A body stimulating mechanical jogger of claim 5, mounted in a horizontal position, and wherein the feet, of a user in a horizontal back laying position, can be attached to the individual foot treadles.

7. A body stimulating mechanical jogger comprising a housing, and mounted therein an electric motor drive, cam wheels, driven by said electric motor drive through a drive belt connected to a driven wheel, rigidly mounted on a shaft, on which shaft said cams are rigidly mounted and said cam wheels in contact with foot treadles to actuate said foot treadles in a reciprocating motion.

* * * * *